United States Patent [19]

Anderson

[11] Patent Number: 4,635,698

[45] Date of Patent: Jan. 13, 1987

[54] CORD EQUALIZER FOR LOCKING TOGETHER A PLURALITY OF CORDS OF A BLIND ASSEMBLY

[75] Inventor: Richard N. Anderson, Owensboro, Ky.

[73] Assignee: Hunger Douglas, Inc., Maywood, N.J.

[21] Appl. No.: 692,201

[22] Filed: Jan. 17, 1985

[51] Int. Cl.[4] ..... E06B 9/322

[52] U.S. Cl. ..... 160/178 C; 24/115 R

[58] Field of Search ..... 160/178 R, 178 C; 24/115 H, 115 R, 136 L

[56] References Cited

U.S. PATENT DOCUMENTS

| | | | |
|---|---|---|---|
| 284,627 | 9/1883 | Goble | 182/5 |
| 538,075 | 4/1895 | Herrberg | 160/178 C |
| 1,599,342 | 9/1926 | Muhlfeld | 24/115 R |
| 2,060,628 | 11/1936 | McCormick | 160/178 C |
| 2,877,527 | 3/1959 | Bond | 24/115 H |
| 4,049,357 | 9/1977 | Hamisch | 24/115 H |
| 4,117,998 | 10/1978 | Notoya | 24/115 R |
| 4,118,838 | 10/1978 | Schiefer | 24/115 R |
| 4,334,413 | 6/1982 | Gaston | 24/115 R |

*Primary Examiner*—Reinaldo P. Machado

*Attorney, Agent, or Firm*—Pennie & Edmonds

[57] ABSTRACT

A cord equalizer for locking together a plurality of cords of a venetian blind assembly. The equalizer has a body member including a body portion having a cut out and two spaced side walls between which a plurality of cords are adapted to be placed. The equalizer also has a locking member having stems thereon adapted to force the cords into the cut out when the locking member is forced between the side walls.

3 Claims, 6 Drawing Figures

CORD EQUALIZER FOR LOCKING TOGETHER A PLURALITY OF CORDS OF A BLIND ASSEMBLY

FIELD OF INVENTION

This invention relates to a cord equalizer for locking together a purality of cords of a blind assembly and more particularly to a cord equalizer having a means for assuring that cords of a venetian blind assembly may be equalized in order that slats of the blind assembly may hang evenly.

BACKGROUND OF INVENTION

Conventional blind assemblies and particularly venetian blind assemblies usually have a purality of lift cords by which slats may be raised or lowered. The problem existing with such conventional assemblies is that one lift cord may be moved relative with respect to a further lift cord so that the slats of the blind will be raised or lowered in an unequalled or skewed manner. This results in an unattractive appearance of the blind assembly.

Lift cords of conventional blind assemblies have been knotted together in an attempt to assure that the cords will move evenly together to obtain even lifting or lowering of the slats. The knot, however, presents an unattractive appearance and, unless securely knotted, it may allow slippage of one cord with respect to an adjacent cord.

It is therefore, an object of my invention to provide for a cord equalizer which will securely lock adjacent cords together to prevent relative slippage between the cords as to assure even raising or lowering of the slats of a blind assembly.

It is a further object of my invention to provide for a cord equalizer that will be unobtrusive and present a small structure which will not distract from the cord configurations.

GENERAL DESCRIPTION OF THE INVENTION

Broadly a cord equalizer according to my invention comprises a main body member having a base portion and two spaced side walls each connected to the base portion and which are adapted to receive a purality of parallel extending cords there between. The base portion includes a cut out between the side walls which preferably may have a square shape. The cord equalizer also include a locking member having a stem where the locking member is adapted to be forced between the spaced side walls of the main body member in order to overlie the cords positioned between the side walls. The locking member includes a stem which is adapted to extend into the cut out of the body member so as to force the cords into the cut out and into a space between the sides of the stem and the sides of the cut out. Preferably the stem is rectangular in shape and has a width less than the sides of the square cut out so as to provide a space into which the cords may be forced. In this manner, the cords are forced into tight close engagement with the side of the cut out resulting in the cords being securely locked against movement with respect to one another.

Preferably the side walls of the main body member have barbs on ends thereof opposite from the base portion. These barbs are adapted to extend over edges of the locking member when the locking member is forced between the side walls such that the barbs will snap over the edges of the locking member to securely hold it in position with respect to the main body member.

Preferably both the main body member and the locking member are made of a translucent plastic material to minimize any contrast between it and the cords and further to provide sufficient flexibility to the members so that they may be locked together with a snap fit.

DESCRIPTION OF THE PREFERRED EMBODIMENT

Figure 1:
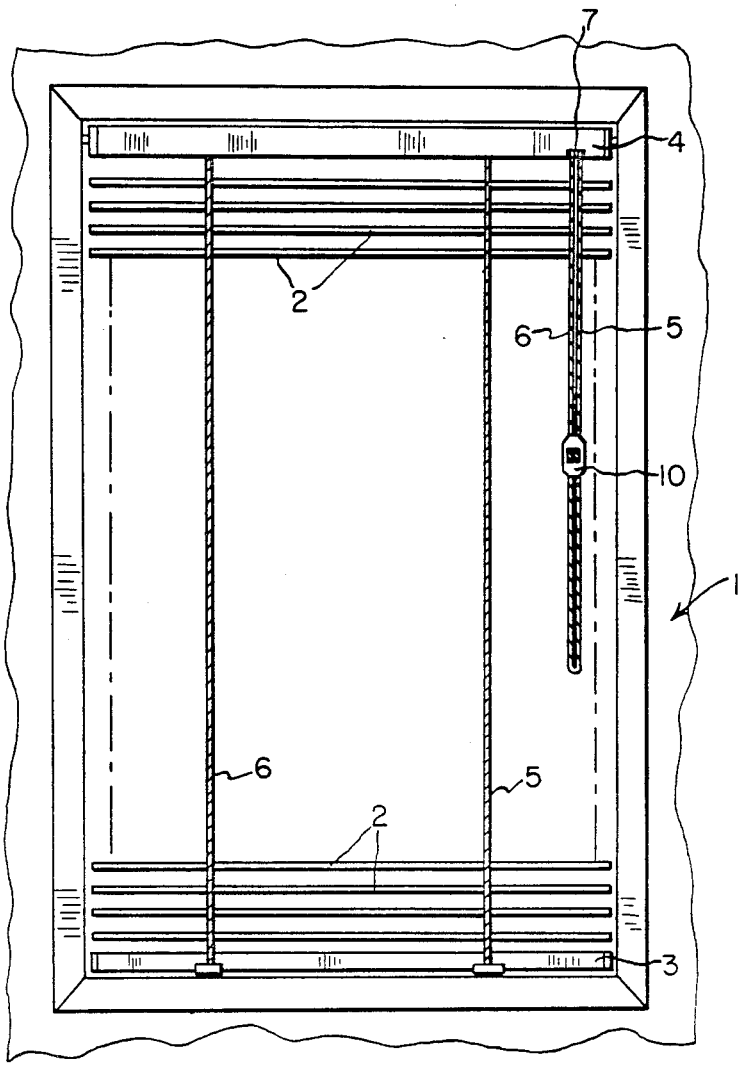
FIG. 1 is a front view of a blind assembly including a cord equalizer according to the invention.
Figure 2:
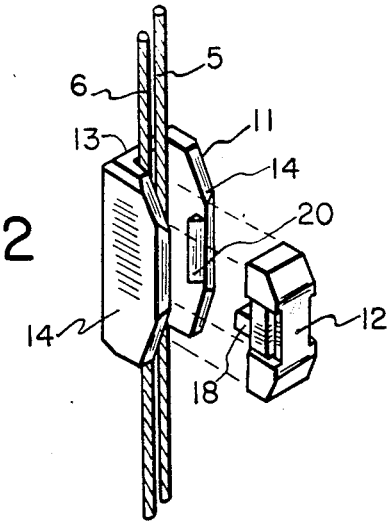
FIG. 2 is an enlarged exploded perspective view of the equalizer FIG. 1.

Referring to FIG. 1 there is illustrated a blind assembly 1 comprising a purality of slats 2 positioned between an end slat 3 and a headrail 4. Lift cords 5 and 6 are connected to the end rail 3 and pass over rollers, not shown, in headrail 4 to exit through an exit hole 7. The cords, as shown, are fastened together by means of a cord equalizer 10. The blind assembly is raised by pulling the cords below the cord equalizer 10 in a downward direction which lifts the end slat 3 and progressively lifts the intervening slats 2. The cords 5 and 6 move to actuate a conventional lift lock, not shown, contained in the headrail to lock the cords in position at the desired height to which the end rail is raised. The blind assembly is lowered by moving the cords 5 and 6 to disengage the lift cord locking devise allowing the weight of the end slat 3 and intervening slats 2 to move the slat assembly in a downward direction.

Figure 3:
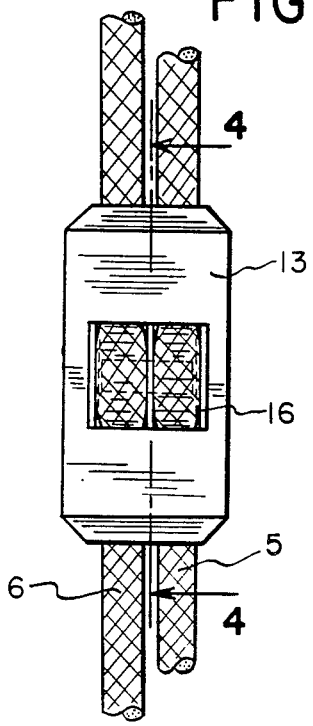
FIG. 3 is an enlarged view of one side of the cord equalizer of FIG. 1.
Figure 4:
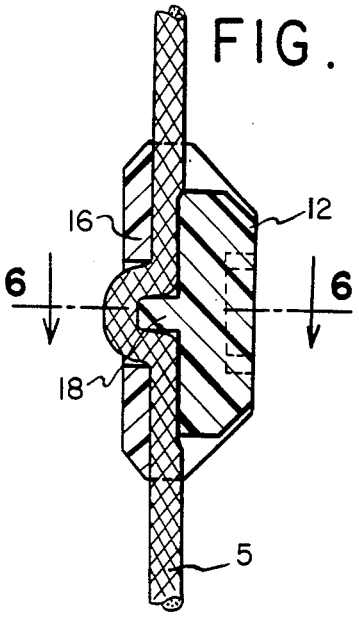
FIG. 4 is a cross sectional view of the cord equalizer of FIG. 3; taken along lines 4—4.

Referring to FIGS. 2–6, the cord equalizer is shown comprising a main body member 11 and a locking member 12. The main body member 11 comprises a base portion 13 to which are connected two spaced side walls 14 as shown in FIGS. 3 and 4. The base portion 13 has a substantially square-shaped cut out 16 into which cords 5 and 6 may be forced.

Figure 5:
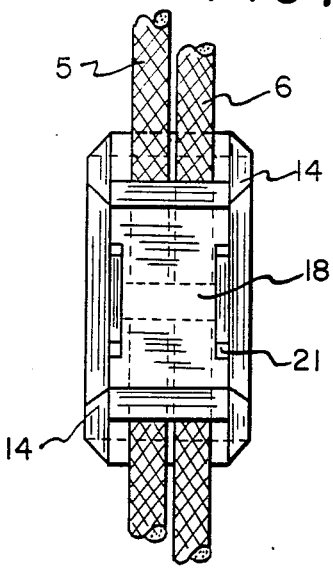
FIG. 5 is a view of the opposite side of the cord equalizer from that of FIG. 3; and, FIG. 6 is a cross sectional view of FIG. 4 taken along lines 6—6.
Figure 6:
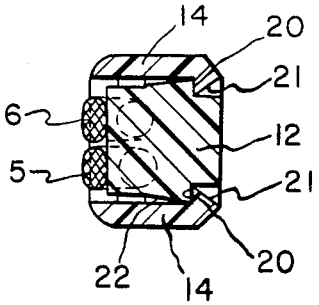

The locking member 12 has a stem 18 thereon which, as shown in FIG. 4, is adapted to force the cords 5 and 6 into the cut out 16 when the locking member is forced between the side walls 14. The stem 18 as shown in FIGS. 4 and 5 is of a substantial rectangular shape, the width of which is less than a side of the square shaped cut out 16. This construction provides a space between the sides of the stem and the sides of the cut out as shown in FIG. 4 into which the cords 5 and 6 may be forced.

As shown in FIG. 4, the cords are wedged against the edges of the square-shaped cut out and of the stem such that they are securely locked with respect to the equalizer structure and thus with respect to each other.

Preferably the side walls 14 are each provided with a barb 20 to engage a shoulder 21 contained on the locking member 12 so as to snap into engagement therewith when the locking member has been forced in between side walls 14. This will securely lock the locking member with respect to the main body member. The locking member 12 may have a side 22 thereof slightly tappered in order to assist in the forcing of the side walls 14 apart and to allow the barbs 20 to be spread sufficiently so that the locking member may be inserted between the side walls and barbs.

Both the main body member and locking member are preferably made of a clear plastic material to minimize any color contrast between the cords and the cord equalizer which could otherwise detract from the cords. Further use of a plastic material assures sufficient flexibility of the side walls 14 allowing them to be forced appart and to be able to have the barbs snap back to engage shoulders 21.

The cord equalizer as described is easy to install on conventional blind assemblies, is extremely small, and the equalizer may be used with any number of cords of a given diameter.

The core equalizer is applied as follows:

The blind assembly is lowered to its maximum point. The cords 5 and 6 are then tensioned but without appling sufficient force to lift the bottom slat 3. The cords are then placed between the side walls 14 of the bottom member while maintaining the tension. The locking member is then forced between the side walls so that the stem 18 will force the cords into the square shaped cut out and until barbs 20 lock the locking member into place.

I claim:

1. A core equalizer for locking together a plurality of cords of a blind assembly comprising a main body member having a base portion and two spaced sidewalls connected to said portion adapted to receive a plurality of parallel extending cords there between, a cut out in said base portion, a locking member having a stem and each side wall having a locking barb on an end thereof opposite said base portion, said locking member adapted to be positioned between said side walls to overlie said cords with said stem adapted to force said cords into said cut out to securely lock said cords against the edges of said cut out, and said barb is adapted to snap over and engage an edge of said locking member when said locking member is forced between said sidewalls to lock said locking member in place on said body member.

2. A cord equalizer according to claim 1 wherein said main bodymember and said locking member are made of a translucent plastic material.

3. A cord equalizer for locking together a plurality of cords of a blind assembly comprising a main body member having a base portion and two spaced side walls connected to said portion adapted to receive a plurality of parallel extending cords there between a substantially square shaped cut out in said base portion, and a locking member having a stem with a substantially rectangular cross-section, said locking member adapted to be positioned between said side walls to overlie said cords with said stem adapted to force said cords into said cut out to securely lock said cords between said stem and the edges of said cut out.

* * * * *

UNITED STATES PATENT AND TRADEMARK OFFICE

CERTIFICATE OF CORRECTION

PATENT NO. : 4,635,698

DATED : January 13, 1987

INVENTOR(S) : Richard N. Anderson

It is certified that error appears in the above-identified patent and that said Letters Patent is hereby corrected as shown below:

On the Title page,
item [73] Assignee: "Hunger" should be --Hunter--.

Signed and Sealed this

Ninth Day of November, 1993

*Attest:*

*Attesting Officer*

BRUCE LEHMAN

*Commissioner of Patents and Trademarks*